US006127612A

United States Patent [19]

Yu

[11] Patent Number: 6,127,612

[45] Date of Patent: Oct. 3, 2000

[54] GUITAR STAND

[76] Inventor: Ming-Ti Yu, 122-5, Jun Liao Road, Feng Yuan, Taichung Hsien, Taiwan

[21] Appl. No.: 09/405,113

[22] Filed: Sep. 27, 1999

[51] Int. Cl.[7] ..... G10D 3/00

[52] U.S. Cl. ..... 84/327; 84/421; 84/453

[58] Field of Search ..... 84/327, 329, 421, 84/453; 248/316.5, 316.7, 443

[56] References Cited

U.S. PATENT DOCUMENTS 6,036,159 3/2000 Yu ..... 248/443

*Primary Examiner*—Paul Ip
*Assistant Examiner*—Shih-yung Hsieh

[57] ABSTRACT

A guitar stand has an inner pipe, an upper bracket disposed on the inner pipe, an outer pipe receiving a lower portion of the inner pipe, a tripod receiving a lower end of the outer pipe, a lower bracket having a support rod disposed on a lower portion of the outer pipe, and a collar disposed on an upper end of the outer pipe. The upper bracket has a fixed hook-shaped rod connected to a bent end of the inner pipe, a support frame disposed on the fixed hook-shaped rod, and a sleeve having a bottom hole receiving the support frame, a round hole receiving a movable hook-shaped rod, and an opening receiving a pivot block and a coiled spring.

3 Claims, 5 Drawing Sheets

GUITAR STAND

BACKGROUND OF THE INVENTION

The invention relates to a guitar stand. More particularly, the invention relates to a guitar stand which can be easily operated with one hand.

U.S. Pat. No. 5,713,547 has disclosed a guitar stand which has a main hollow rod, a first hollow leg, a second hollow leg, a first brace, a second brace, a first bracket, and a second bracket. A pivot means fastens the first hollow leg and the second hollow leg on the main hollow rod pivotally. A hollow upper block is disposed on top of the main hollow rod. The pivot means has a lobe, a transverse plate and a longitudinal plate which is disposed on top of the transverse plate. A main hollow rod has a lobe disposed on an upper portion of the main hollow rod. A circular hole and a curved hole are formed on the main hollow rod. A hollow upper block has a lower protrusion inserted in an upper end of the main hollow rod. A first and a second round cushions are disposed adjacent to a first and a second sides of the hollow upper block, respectively. The first round cushion has a first center hole. The second round cushion has a second center hole. A first bolt passes through the first center hole to fasten the first round cushion on the hollow upper block. A second bolt passes through the second center hole to fasten the second round cushion on the hollow upper block. A longitudinal plate is disposed on a top of the transverse plate. The longitudinal plate has an upper hole to match the corresponding circular hole and a lower hole to match the corresponding curved hole. A first fastening member passes through the circular hole and the upper hole and a second fastening member passes through the lower hole and the curved hole to fasten the lobe and the longitudinal plate together. A first and a second joints are disposed on the first and the second hollow legs, respectively. Each of the first and the second joints has a threaded lower portion inserted in a top interior of the corresponding hollow leg, an annular flange abutting the threaded lower portion, and a top recess to receive the transverse plate. A bevel is disposed beneath the top recess. A notch is formed on a top rim of the first hollow leg. A third and a fourth fastening members fasten the first and the second joints on the transverse plate. The first brace is fastened on a lower portion of the first hollow leg. The second brace is fastened on a lower portion of the second hollow leg. A first hook extends from a top end of the first bracket to be inserted in the first brace. A second hook extends from a top end of the second bracket to be inserted in the second brace. However, the hollow leg will be detached from the respective joint if the user extends the hollow leg to the utmost.

SUMMARY OF THE INVENTION

An object of the present invention is to provide a guitar stand which is easily operated with one hand.

Yet another object of the present invention is to provide a guitar stand which has a collar and a threaded button engaging with the collar so that the threaded button will not disengage from the collar.

Accordingly, a guitar stand comprises an inner pipe, an upper bracket disposed on the inner pipe, an outer pipe receiving a lower portion of the inner pipe, a tripod receiving a lower end of the outer pipe, a lower bracket having a support rod disposed on a lower portion of the outer pipe, and a collar disposed on an upper end of the outer pipe. The upper bracket has a movable hook-shaped rod, a fixed hook-shaped rod connected to a bent end of the inner pipe, a support frame disposed on the fixed hook-shaped rod, and a sleeve having a bottom hole receiving the support frame, a round hole receiving the movable hook-shaped rod, and an opening receiving a pivot block and a coiled spring. The coiled spring surrounds a lower portion of the pivot block. The pivot block has a groove receiving an upper end of the coiled spring. The support frame has a protruded block. The pivot block has a center hole receiving the support frame and a positioning recess communicating with the center hole. The center hole of the pivot block receives the protruded block. A ring is disposed on the collar. The ring has a threaded hole communicating with an interior of the collar. A nut is inserted in the threaded hole. A threaded button passes through the threaded hole, the nut, and a through hole of the outer pipe.

DETAILED DESCRIPTION OF THE INVENTION

Figure 1:
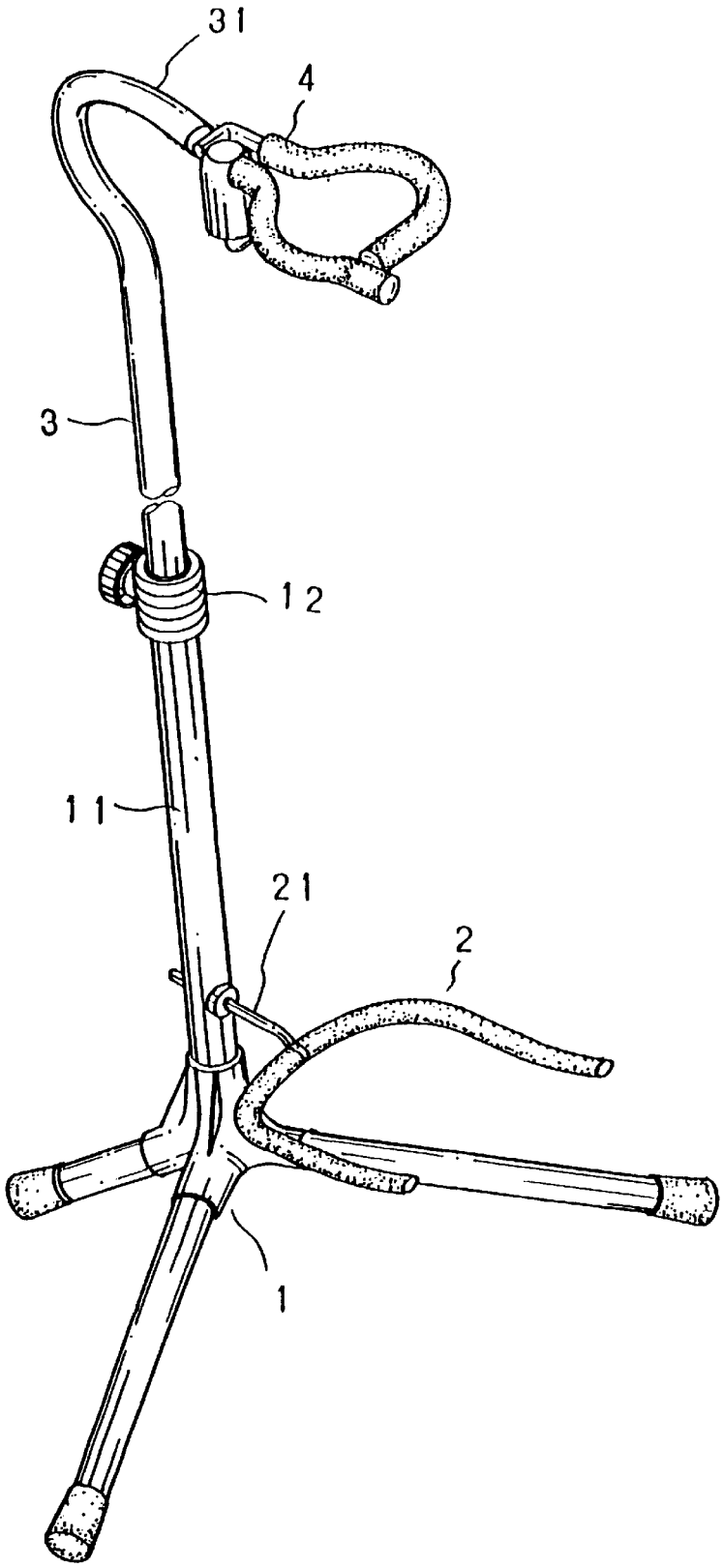
FIG. 1 is a perspective assembly view of a guitar stand of a preferred embodiment in accordance with the present invention.
Figure 2:
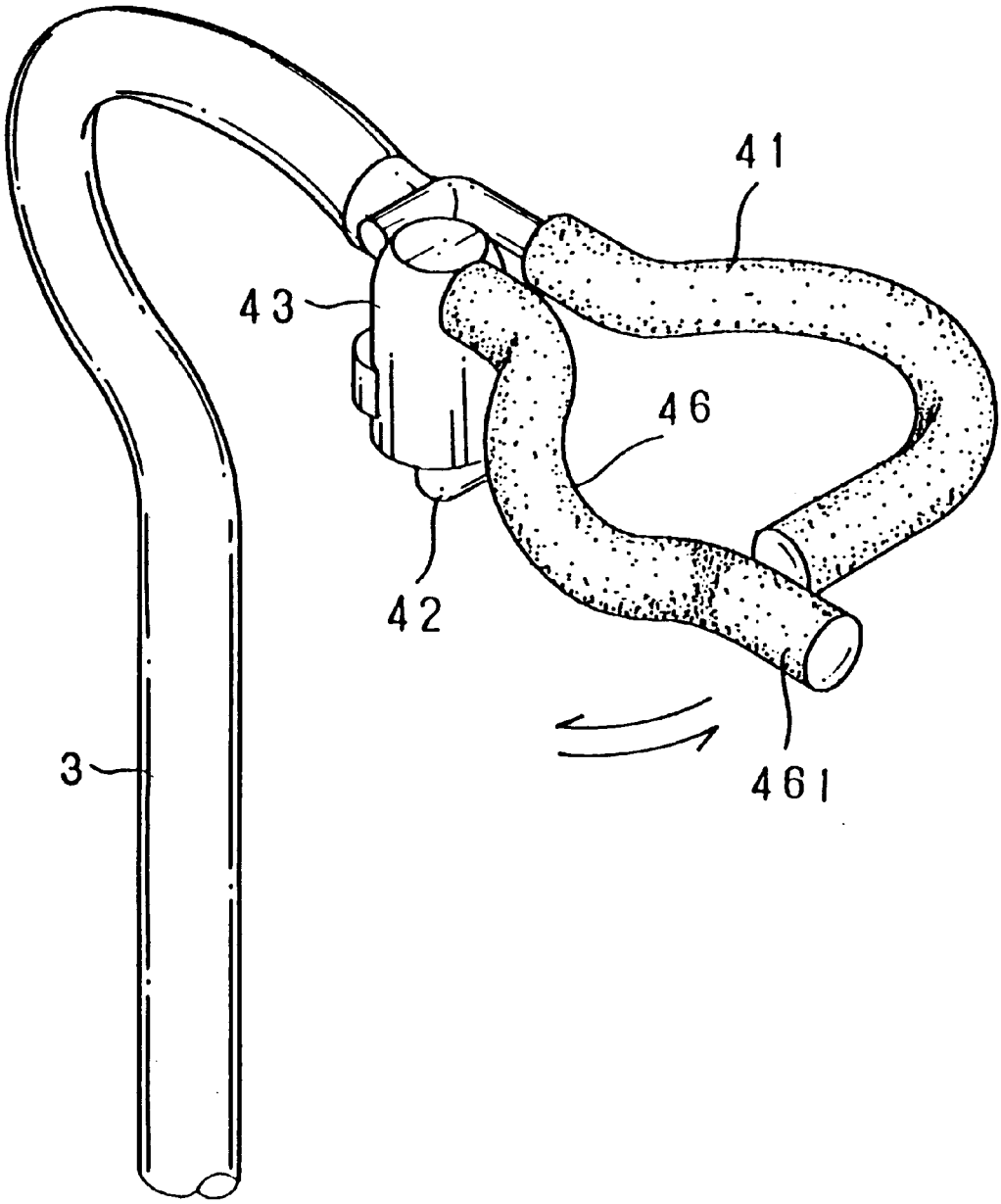
FIG. 2 is a perspective assembly view of an inner pipe and an upper bracket of a preferred embodiment in accordance with the present invention.
Figure 3:
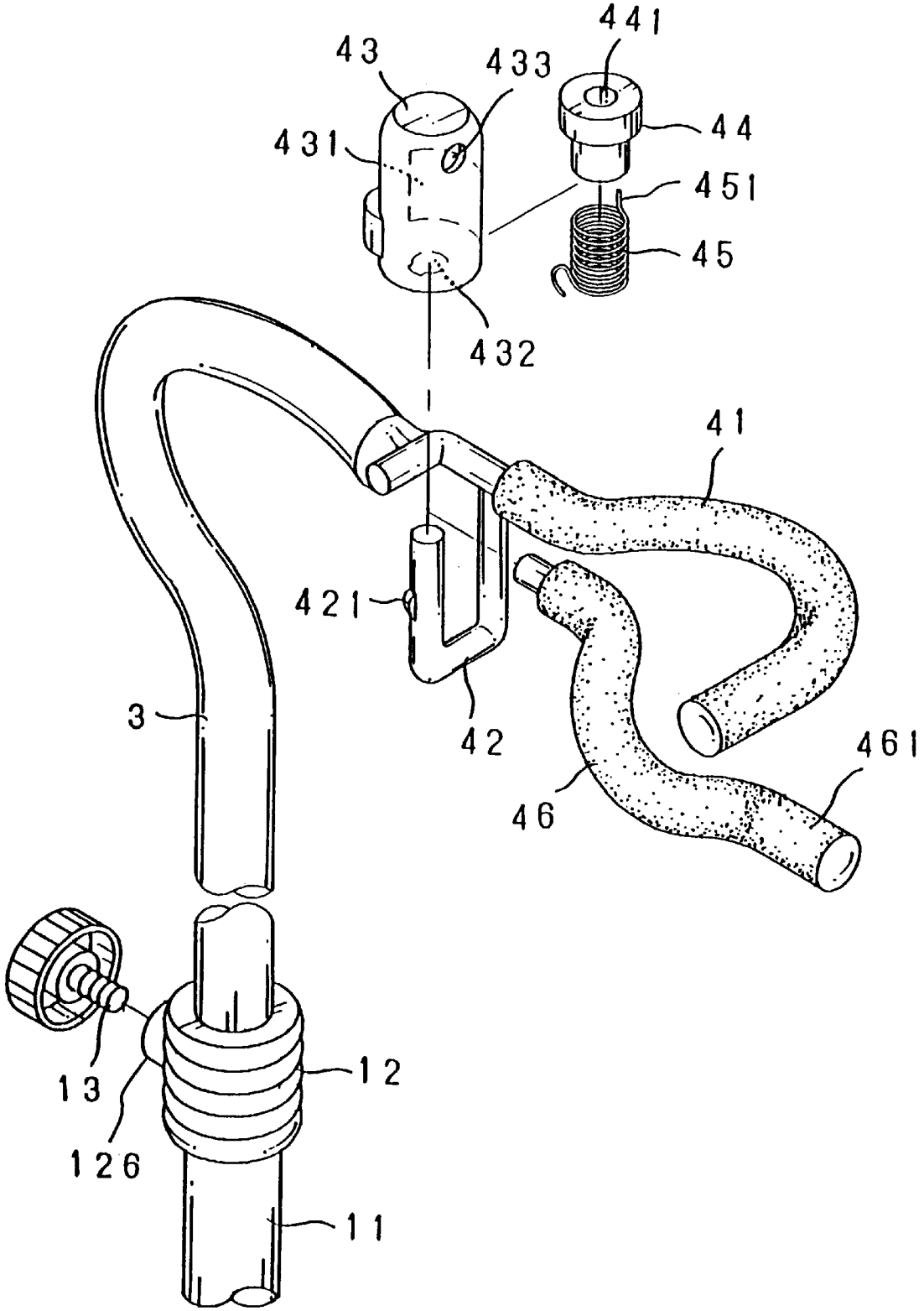
FIG. 3 is a perspective exploded view of an inner pipe, an upper bracket, a sleeve, and a pivot block of a preferred embodiment in accordance with the present invention.
Figure 4:
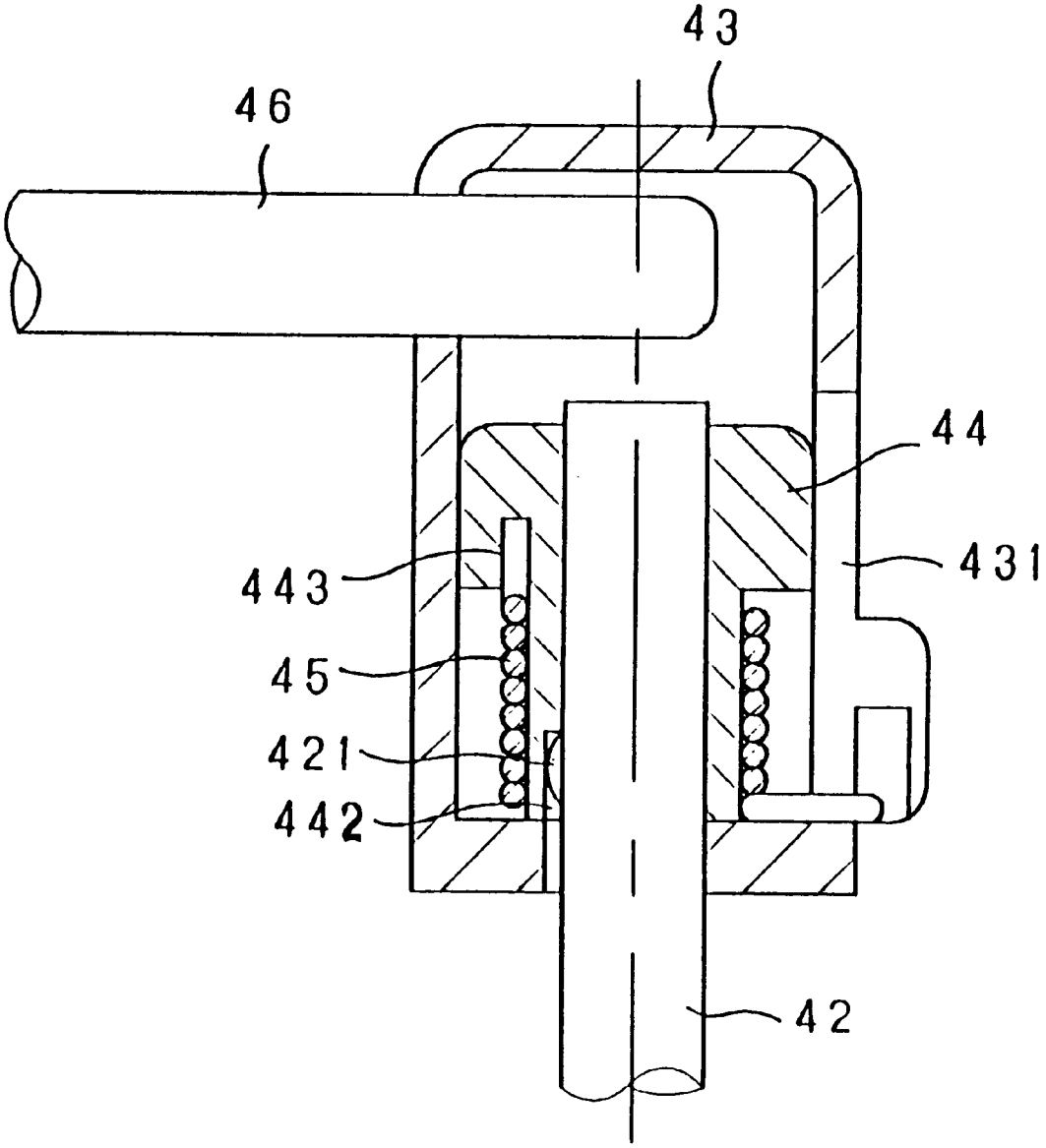
FIG. 4 is a sectional assembly view of a sleeve, a coiled spring, a pivot block, and a movable hook-shaped rod of a preferred embodiment in accordance with the present invention.
Figure 5:
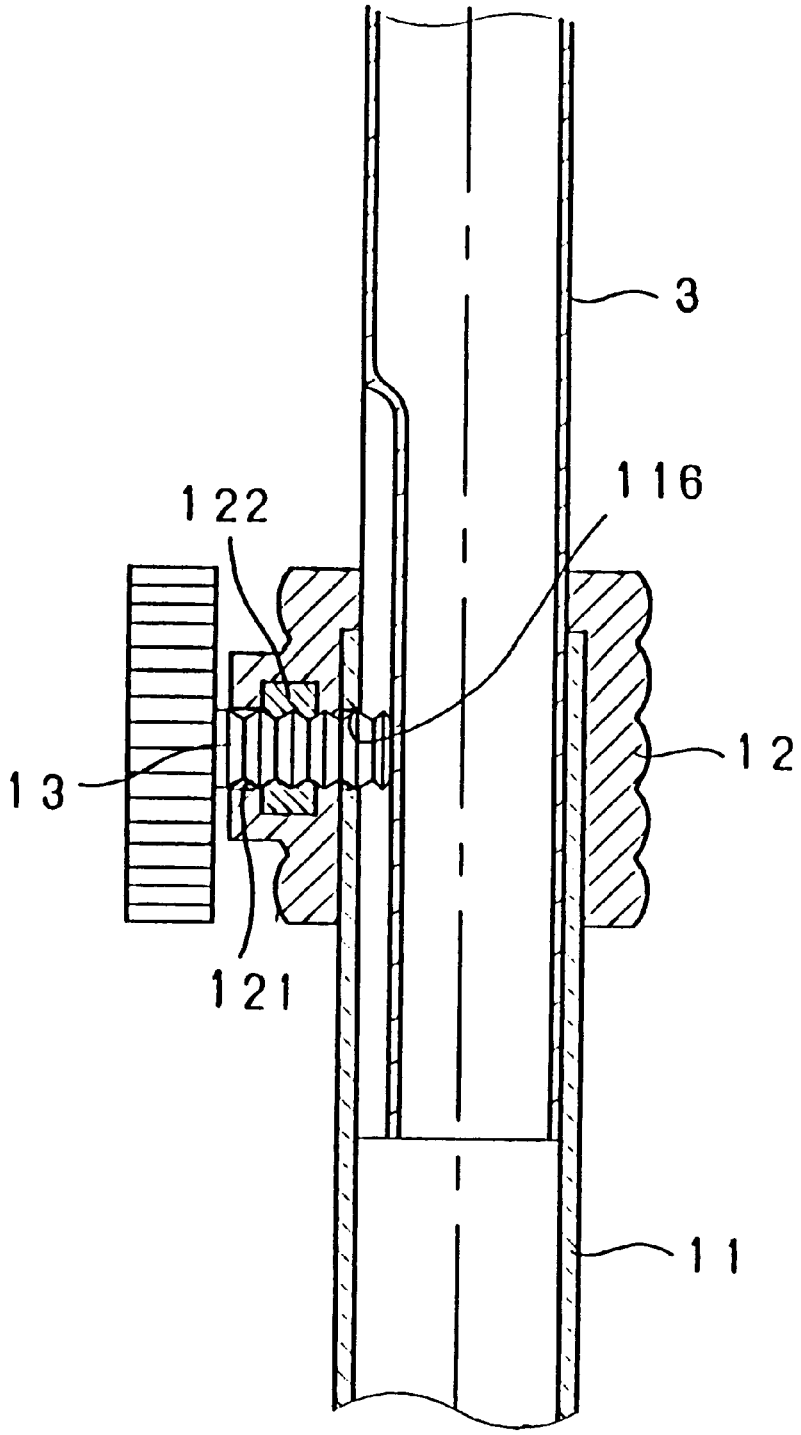
FIG. 5 is a sectional assembly view of a collar and a threaded button of a preferred embodiment in accordance with the present invention.

Referring to FIGS. 1 to 5, a guitar stand comprises an inner pipe 3, an upper bracket 4 disposed on the inner pipe 3, an outer pipe 11 receiving a lower portion of the inner pipe 3, a tripod 1 receiving a lower end of the outer pipe 11, a lower bracket 2 having a support rod 21 disposed on a lower portion of the outer pipe 11, and a collar 12 disposed on an upper end of the outer pipe 11.

The upper bracket 4 has a movable hook-shaped rod 46, a fixed hook-shaped rod 41 connected to a bent end 31 of the inner pipe 3, a support frame 42 disposed on the fixed hook-shaped rod 41, and a sleeve 43 having a bottom hole 432 receiving the support frame 42, a round hole 433 receiving the movable hook-shaped rod 46, and an opening 431 receiving a pivot block 44 and a coiled spring 45. The coiled spring 45 surrounds a lower portion of the pivot block 44. The pivot block 44 has a groove 443 receiving an upper end 451 of the coiled spring 45.

The support frame 42 has a protruded block 421. The pivot block 44 has a center hole 441 receiving the support frame 42 and a positioning recess 442 communicating with the center hole 441. The center hole 441 of the pivot block 44 receives the protruded block 421.

A ring 126 is disposed on the collar 12. The ring 126 has a threaded hole 121 communicating with an interior of the collar 12. A nut 122 is inserted in the threaded hole 121. A threaded button 13 passes through the threaded hole 121, the nut 122, and a through hole 116 of the outer pipe 11.

The movable hook-shaped rod 46 is longer than the fixed hook-shaped rod 41 so that the user can move the movable hook-shaped rod 46 easily.

When the movable hook-shaped rod 46 is moved, the sleeve 43 is rotated according to the motion of the movable hook-shaped rod 46. The user can move the movable hook-shaped rod 46 with one hand.

The present invention is not limited to the above embodiment but various modification thereof may be made. Furthermore, various changes in form and detail may be made without departing from the scope of the present invention.

I claim:

1. A guitar stand comprises:

an inner pipe, an upper bracket disposed on the inner pipe, an outer pipe receiving a lower portion of the inner pipe, a tripod receiving a lower end of the outer pipe, a lower bracket having a support rod disposed on a lower portion of the outer pipe, and a collar disposed on an upper end of the outer pipe, the upper bracket having a movable hook-shaped rod, a fixed hook-shaped rod connected to a bent end of the inner pipe, a support frame disposed on the fixed hook-shaped rod, and a sleeve having a bottom hole receiving the support frame, a round hole receiving the movable hook-shaped rod, and an opening receiving a pivot block and a coiled spring, the coiled spring surrounding a lower portion of the pivot block, the pivot block having a groove receiving an upper end of the coiled spring, the support frame having a protruded block, the pivot block having a center hole receiving the support frame and a positioning recess communicating with the center hole, and the center hole of the pivot block receiving the protruded block.

2. The guitar stand as claimed in claim 1, wherein the movable hook-shaped rod is longer than the fixed hook-shaped rod.

3. The guitar stand as claimed in claim 1, wherein a ring is disposed on the collar, the ring has a threaded hole communicating with an interior of the collar, a nut is inserted in the threaded hole, and a threaded button passes through the threaded hole, the nut, and a through hole of the outer pipe.

* * * * *